US009689217B2

(12) United States Patent
Holtby et al.

(10) Patent No.: US 9,689,217 B2
(45) Date of Patent: Jun. 27, 2017

(54) APPARATUS AND METHOD FOR CONTAINING FLUID OR GAS RELEASED FROM A PIPE

(75) Inventors: Quinn A. J. Holtby, Edmonton (CA); Dallas Laird Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 1432 days.

(21) Appl. No.: 14/348,557

(22) PCT Filed: Aug. 20, 2010

(86) PCT No.: PCT/CA2010/001286

§ 371 (c)(1),
(2), (4) Date: Mar. 28, 2014

(87) PCT Pub. No.: WO2011/020196

PCT Pub. Date: Feb. 24, 2011

(65) Prior Publication Data

US 2014/0238530 A1 Aug. 28, 2014

Related U.S. Application Data

(60) Provisional application No. 61/235,645, filed on Aug. 20, 2009.

(51) Int. Cl.

| | |
|---|---|
| ***E21B 21/01*** | (2006.01) |
| ***E21B 33/08*** | (2006.01) |
| ***E21B 19/16*** | (2006.01) |

(52) U.S. Cl.

CPC ..... *E21B 21/01* (2013.01); *E21B 19/16* (2013.01); *E21B 33/08* (2013.01)

(58) Field of Classification Search

CPC ..... E21B 19/16; E21B 21/01; E21B 33/08; E21B 2021/007

See application file for complete search history.

(56) References Cited

U.S. PATENT DOCUMENTS

| | | | |
|---|---|---|---|
| 234,825 | A | 11/1880 | Walker |
| 319,693 | A | 6/1885 | Garrett |

(Continued)

FOREIGN PATENT DOCUMENTS

| | | | |
|---|---|---|---|
| CA | 0 309 693 | A | 2/1932 |
| CA | 2 163 322 | A1 | 11/1997 |

(Continued)

OTHER PUBLICATIONS

Gaddy, D.E., "Equipment Upgrades Minimize Drillstring Fluid Losses," Oil & Gas Journal 97(31):59-61, Aug. 1999.

(Continued)

*Primary Examiner* — David Andrews
(74) *Attorney, Agent, or Firm* — Christensen O'Connor Johnson Kindness PLLC

(57) ABSTRACT

An apparatus and method is provided for containing fluid or gas that is released when two adjoining sections of pipe are disconnected. The apparatus can comprise two or more arcuate sections hinged together to form a generally cylindrical or tubular containment chute that can be releasably enclosed around a pipe joint. Latching mechanisms can hold the apparatus around the pipe joint. The apparatus can have one or more sealing members at each end of the containment chute that engage the pipe above and below the pipe joint so that the pipe joint is completely enclosed and sealed off. A spout located on the sidewall of the apparatus allows fluid or gas that is released when the pipe joint is broken to flow from the apparatus through the spout into a hose connected to the spout, whereby the hose can divert the fluid or gas to a receptacle or container.

20 Claims, 9 Drawing Sheets

(56) References Cited

U.S. PATENT DOCUMENTS

| | | | | |
|---|---|---|---|---|
| 560,986 | A | 5/1896 | Grow | |
| 970,880 | A | 9/1910 | Bouchet | |
| 1,369,913 | A * | 3/1921 | Brunhoff | E21B 33/08 166/81.1 |
| 1,390,793 | A | 9/1921 | Kyle et al. | |
| 1,418,612 | A | 6/1922 | Beard | |
| 1,448,172 | A | 3/1923 | Wellensiek | |
| 1,448,243 | A | 3/1923 | Wilson | |
| 1,542,776 | A | 6/1925 | Ingram | |
| 1,547,461 | A | 7/1925 | Steele | |
| 1,632,889 | A | 6/1927 | Davis | |
| 1,809,175 | A | 7/1931 | Loomis | |
| 1,868,794 | A | 7/1932 | Fuller et al. | |
| 1,910,045 | A | 5/1933 | Paryzek | |
| 2,068,665 | A | 1/1937 | Douglass | |
| 2,096,882 | A | 10/1937 | Chernosky | |
| 2,137,832 | A | 11/1938 | Cordes | |
| 2,214,428 | A | 9/1940 | Miller | |
| 2,328,127 | A | 8/1943 | Crickmer | |
| 2,329,461 | A | 9/1943 | Flynn | |
| 2,353,412 | A | 7/1944 | Miller | |
| 2,505,282 | A | 8/1950 | Endsley | |
| 2,522,444 | A | 9/1950 | Grable | |
| 2,605,083 | A | 7/1952 | Collins | |
| 2,610,690 | A | 9/1952 | Beatty | |
| 2,716,455 | A | 8/1955 | Jones, Jr. | |
| 2,850,754 | A | 9/1958 | Davis | |
| 3,270,810 | A | 9/1966 | Johnston | |
| 3,322,198 | A | 5/1967 | McHenry | |
| 3,353,606 | A | 11/1967 | Dyer | |
| 3,559,739 | A | 2/1971 | Hutchison | |
| 3,738,436 | A | 6/1973 | Litchfield et al. | |
| 3,783,939 | A | 1/1974 | Edge et al. | |
| 3,822,753 | A | 7/1974 | Tate | |
| 3,847,372 | A | 11/1974 | Litchfield | |
| 3,953,037 | A * | 4/1976 | Winfield, Jr. | E21B 33/08 277/503 |
| 4,355,826 | A | 10/1982 | Von Braun | |
| 4,450,905 | A | 5/1984 | Crain | |
| 4,553,637 | A | 11/1985 | Tanner | |
| 4,665,976 | A | 5/1987 | Retherford | |
| 5,150,751 | A | 9/1992 | Burton et al. | |
| 5,295,536 | A | 3/1994 | Bode | |
| 5,351,753 | A | 10/1994 | Golson | |
| 5,394,939 | A | 3/1995 | Walker | |
| 5,551,511 | A | 9/1996 | Holtby | |
| 5,775,419 | A | 7/1998 | Gramlich | |
| 6,119,772 | A | 9/2000 | Pruet | |
| 6,155,358 | A | 12/2000 | Brown | |
| 6,199,254 | B1 | 3/2001 | Suresh | |
| 6,591,916 | B1 | 7/2003 | Ayling | |
| 7,306,032 | B2 | 12/2007 | Paton | |
| 7,490,677 | B2 | 2/2009 | Buytaert et al. | |
| 7,654,313 | B2 | 2/2010 | Angman | |
| 8,251,151 | B2 | 8/2012 | Haugen | |
| 8,439,060 | B1 | 5/2013 | Jackson | |
| 2002/0179300 | A1 | 12/2002 | Gay et al. | |
| 2004/0227347 | A1 | 11/2004 | Fundin et al. | |
| 2011/0108278 | A1 | 5/2011 | Holtby | |
| 2011/0265992 | A1 | 11/2011 | Pearson | |
| 2014/0124222 | A1 | 5/2014 | Holtby | |
| 2014/0238530 | A1 | 8/2014 | Holtby | |

FOREIGN PATENT DOCUMENTS

| | | | |
|---|---|---|---|
| CA | 2 187 717 | A1 | 4/1998 |
| CA | 2 236 047 | A1 | 3/1999 |
| CA | 2 702 567 | A1 | 10/2010 |
| CA | 2 797 836 | A1 | 5/2014 |
| EP | 2 483 515 | A1 | 8/2012 |
| WO | 2014/197981 | A1 | 12/2014 |

OTHER PUBLICATIONS

Katch Kan™, "KatchKanSystem: Advanced Fluid Technologies: The Service Rig Zero Spill System,"<http://advanced-fluid-technologies.com/product1A.htm> [originally retrieved Sep. 9, 2014], 5 pages.

Katch Kan™, "Contractor Advantage" (Brochure), Last Revision: Dec. 1, 2009, pp. 1-10.

Katch Kant™, "Doghouse Poster v1.12-11: Rig Safety Systems™, Zero Spill System™, Well Servicing Zero Spill System™," [accessed May 13, 2015], 2 pages.

Katch Kant™, Katch Kan and Kelly Kan for Drilling Rigs (Posters), before Apr. 2013, 3 pages.

Katch Kant™, "Kelly Kan™" (Brochure excerpt), Jun. 2007, pp. 6-7.

Katch Kant™, Katch Kant™ / Katch Kant™ MDS: Minimum Discharge Systems for Well Servicing (Brochure), before Apr. 2013, 8 pages.

Katch Kant™, "Operator Advantages" (Brochure), 2009, 12 pages.

Katch Kant™, Undertaking No. 50, marketing sheet photographs, before Apr. 2013, 1 page.

Supplementary European Search Report mailed Mar. 13, 2017, issued in corresponding Application No. EP 10 80 9410, filed Aug. 20, 2010, 7 pages.

* cited by examiner

APPARATUS AND METHOD FOR CONTAINING FLUID OR GAS RELEASED FROM A PIPE

TECHNICAL FIELD

The present disclosure is related to the field of mud cans, also known as "Kelly cans", in particular, tubular enclosures for directing fluid or gas released when a threaded joint is disconnected between adjoining drilling pipe sections or between a Kelly and a pipe section.

BACKGROUND

During the drilling of a well, drilling fluid is pumped down a hollow drill string and through the drill bit attached thereon. The drill string consists of a plurality of joined sections of pipe. The drilling fluid is pumped down the drill string using a device known as a "Kelly". The Kelly is attached to the top of the drill string and is a connected to a source of pressurized drilling fluid via a hose. The Kelly is configured to allow the drill string to rotate when drilling the well while the hose remains generally stationary. Pressurized drilling fluid is, thus, pumped through Kelly into the drill string during drilling operations.

The drilling fluid serves to carry cuttings produced by the drill bit to the surface in the space between the drill string and the walls of the well hole being drilled. This space is often referred to as the "annulus". The drilling fluid also creates a hydrostatic pressure in the annulus that prevents produced substances from blowing out of the well.

The process of removing the drill string from the well consists of raising the drill string out of the well and disconnecting one or more sections of joined pipe from the drill string. This process is often referred to as "tripping out". Before the pipe sections are removed, the Kelly is removed from the drill string. A Kelly and its associated hose can contain approximately 20 gallons of drilling fluid that is under considerable pressure. The sections of pipe being tripped out also contain drilling fluid inside. When the Kelly or a pipe section is disconnected from the drill string, the drilling fluid in the Kelly or the pipe section spills out uncontrollably over the drilling rig floor and the personnel drilling the well. This results in an unsafe and hazardous environment for the personnel to work in.

It is, therefore, desirable to provide an apparatus that prevents the spilling of drilling fluid on the drilling rig floor when the Kelly or when sections of pipe in a drill string are disconnected.

SUMMARY

An apparatus and method for containing fluids or gas released from a pipe is provided. The apparatus can comprise two or more arcuate sections hinged together to form a generally cylindrical or tubular containment chute that can be releasably enclosed around a pipe joint. Latching mechanisms can be used to hold the apparatus around the pipe joint. The apparatus can have one or more sealing members at each end of the containment chute that engage the pipe above and below the pipe joint so that the pipe joint is completely enclosed and sealed off. The sealing members can be of different sizes to provided staged sealing about the pipe joint. A spout can be located on the sidewall of the apparatus that allows drilling fluid that is released when the pipe joint is broken to flow from the apparatus through the spout into a hose connected to the spout, whereby the hose can divert the drilling fluid to a receptacle for recycling and reuse.

For the purposes of this specification and the claims contained herein, the term "rig" shall be deemed to include all forms of "rigs" known to those skilled in the oil and gas industry including "drilling rigs", "test rigs", "service rigs" and "off-shore rigs". The term "pipe" shall be deemed to include "drill pipe", "drill collars", "tubulars", "saver subs" or "thread-saver subassemblies", "core barrels", "top drive quills", "coiled tubing", "production tubing", "down-hole assemblies", "bottom-hole assemblies" and any other known tool or device having a threaded pipe joint connector that allows the connection to a pipe section containing fluid or gas.

For the purposes of this specification and the claims contained herein, the term "pipe joint" shall refer to connections between the Kelly and a pipe section, and to connections between adjoining pipe sections.

Broadly stated, an apparatus is provided for use in containing fluid or gas that is released upon disconnection of a threaded joint between sections of pipe or between a Kelly and a pipe section, the apparatus comprising: at least two arcuate sections of a generally tubular housing having upper and lower ends and outer and inner surfaces, the sections hinged together and configured to substantially enclose the threaded joint thereby providing a generally cylindrical enclosure disposed about the threaded joint; a handle disposed on at least one arcuate section; at least one upper groove disposed on the inner surface of the upper end of each arcuate section whereby at least one upper circumferential groove is formed on the inner surfaces when the arcuate sections are enclosed about the threaded joint; at least one lower groove disposed on the inner surface of the lower end of each arcuate section whereby at least one lower circumferential groove is formed on the inner surfaces when the arcuate sections are enclosed about the threaded joint; sealing means disposed in the at least one upper and lower circumferential grooves for providing a sealing contact with the Kelly or with the drilling pipe when the arcuate sections are enclosed about the threaded joint; latching means for releasably latching the arcuate sections together when the housing is enclosed about the threaded joint, the latching means comprising at least one latching mechanism; and a spout disposed on the outer surface of at least one arcuate section near the lower end and above the at least one lower groove, the spout configured to provide communication between the outer and inner surfaces thereby providing a path for drilling fluid to flow through when the arcuate sections are enclosed about the threaded joint and the threaded joint is disconnected.

Broadly stated, a method is provided for containing fluid or gas that is released upon disconnection of a threaded joint between sections of pipe or between a Kelly and a pipe section, the method comprising the steps of: providing an apparatus, comprising: at least two arcuate sections of a generally tubular housing having upper and lower ends and outer and inner surfaces, the arcuate sections hinged together and configured to substantially enclose the threaded joint thereby providing a generally cylindrical enclosure disposed about the threaded joint, a handle disposed on at least one tubular housing section, at least one upper groove disposed on the inner surface of the upper end of each arcuate section whereby at least one upper circumferential groove is formed on the inner surfaces when the arcuate sections are enclosed about the threaded joint, at least one lower groove disposed on the inner surface of the lower end of each arcuate section whereby at least one lower circumferential groove is formed on the inner surfaces when the arcuate sections are enclosed about the threaded joint, sealing means disposed in the at least one upper and lower circumferential grooves for providing a sealing contact with the Kelly or with the drilling pipe when the sections are enclosed about the threaded joint, latching means for releasably latching the arcuate sections together when the arcuate sections are enclosed about the threaded joint, the latching means comprising at least one latching mechanism, and a spout disposed on the outer surface of at least one arcuate section near the lower end and above the at least one lower groove, the spout configured to provide communication between the outer and inner surfaces thereby providing a path for drilling fluid to flow through when the housing is enclosed about the threaded joint and the threaded joint is disconnected; placing the apparatus around the threaded joint, thereby enclosing the threaded joint; attaching one end of a hose to the spout, and placing the other end of the hose at a receptacle; and disconnecting the thread joint within the apparatus, whereby drilling fluid exiting from the Kelly from the drilling pipe section flows through from the apparatus through the spout and the hose to the receptacle.

DETAILED DESCRIPTION OF EMBODIMENTS

Figure 1:
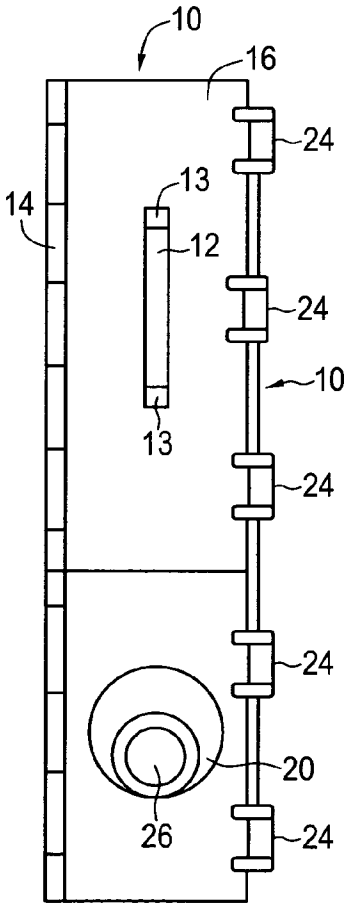
FIG. 1 is a front elevation view depicting a first embodiment of an apparatus for preventing the spilling of drilling fluid onto a drilling rig floor.

An apparatus and method for preventing the spilling of drilling fluid onto a drilling rig floor is provided. Referring to FIGS. 1 to 4, two embodiments of a "Kelly kan" are shown as represented by apparatus 10. In these embodiments, apparatus 10 can be configured as a tubular member formed by a plurality of arcuate sections that are hinged together to form a containment chute when enclosed about a Kelly or a tubing joint. In the illustrated embodiments, apparatus 10 can comprise arcuate sections 16 and 18 hinged together along one edge with hinge 14. While representative embodiments comprise two arcuate or semi-circular sections, it is obvious to those skilled in the art that three or more hinged arcuate sections can be used to form apparatus 10. Apparatus 10 can be comprised of any suitable material rated for use with produced substances, drilling fluids and muds, or fracturing fluids. In a representative embodiment, apparatus 10 can be comprised of high-density urethane polymer plastic to make apparatus 10 strong, lightweight and durable as well as being resilient to the fluids and gas that can come in contact with apparatus 10. In other embodiments, apparatus 10 can be comprised of other materials having similar properties as well known to those skilled in the art.

In operation, apparatus 10 can be opened by spreading sections 16 and 18 away from each other to allow apparatus 10 to be placed around a pipe joint. Sections 16 and 18 can then be pushed together to form the containment chute that completely encloses the pipe joint. Apparatus 10 can further comprise one or more handles 12 to allow personnel to manipulate apparatus 10 on and off pipe joints. In a further embodiment, handle 12 can comprise chamfered corners 13 as a safety feature to allow personnel place their thumbs on to avoid potential crush injuries from other equipment on the drilling rig floor such as the power tongs used to hold sections of pipe.

Figure 2:
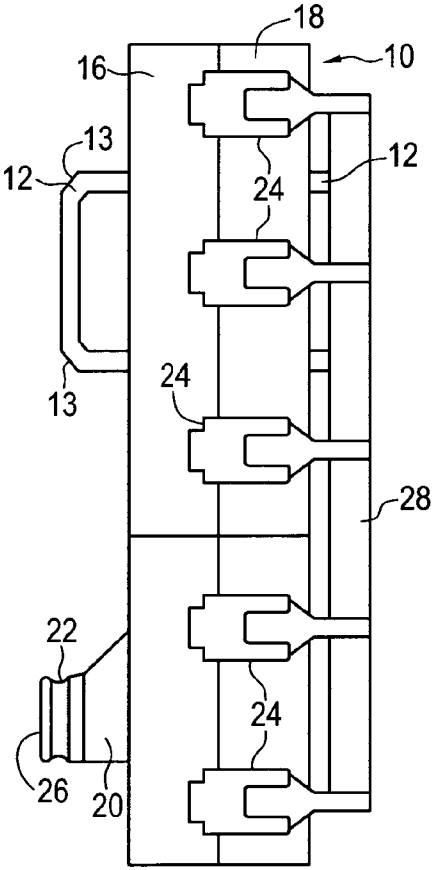
FIG. 2 is a side elevation view depicting the apparatus of FIG. 1.
Figure 3:
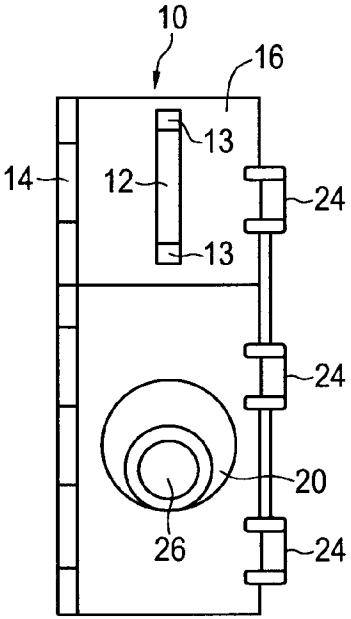
FIG. 3 is a front elevation view depicting a second embodiment of an apparatus for preventing the spilling of drilling fluid onto a drilling rig floor.
Figure 4:
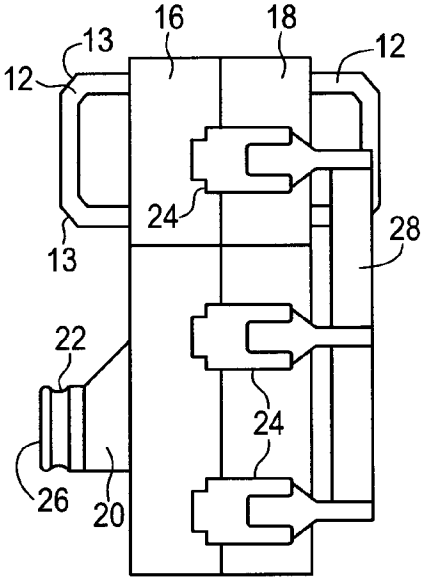
FIG. 4 is a side elevation view depicting the apparatus of FIG. 3.

In the illustrated embodiments, hinge 14 can comprise a "piano hinge" style of hinge although any suitable hinge can be used. In each of these illustrated embodiments, apparatus 10 can comprise a plurality of latch mechanisms 24 disposed in a spaced-apart configuration along one edge of apparatus 10 to releasably join sections 16 and 18 together. FIGS. 1 and 2 illustrate an embodiment of apparatus 10 that is longer than the embodiment shown in FIGS. 3 and 4. In FIG. 1, apparatus 10 is shown comprising 5 latch mechanisms 24 whereas in FIG. 3, apparatus 10 is shown comprising 3 latch mechanisms 24. It is obvious to those skilled in the art that the length of apparatus 10 and the number of latch mechanisms 24 can be selected as a design choice to build apparatus 10 to a desired length depending on the type and size of the Kelly or tubing joint to be enclosed by apparatus 10. In further embodiments, apparatus 10 can comprise spout 20 disposed on a sidewall of apparatus 10. Spout 20 provides communication to interior 11 of apparatus 10 to allow drilling fluid to exit from apparatus 10 through outlet 26 when the pipe joint is broken. In a representative embodiment, spout 20 can be disposed towards the lower end of apparatus 10 to minimize the amount of drilling fluid retained in apparatus 10 when enclosed around a pipe joint that is being broken.

As shown in FIGS. 1 to 4, apparatus 10 can comprise a plurality of latch mechanisms to attach sections 16 and 18 together. In a further embodiment, the plurality of latch mechanisms 24 can be "ganged together" with latch handle 28 whereby all latch mechanisms 24 can be operated as a single group by using latch handle 28 to either open or close latch mechanisms 24.

Figure 5:
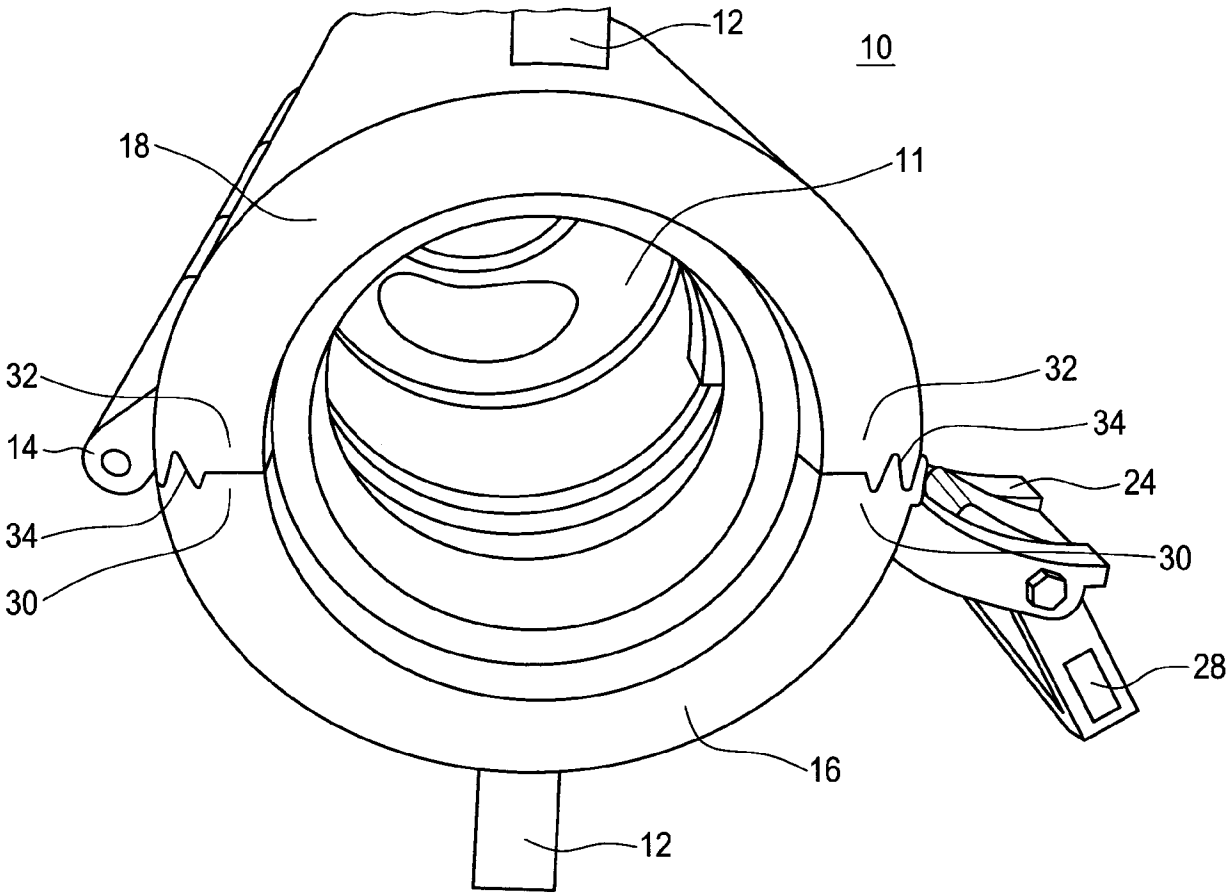
FIG. 5 is a top perspective view depicting the apparatus of FIG. 3 in a closed position.

Referring to FIG. 5, the top end of apparatus 10 is shown, with apparatus 10 in a closed position. In this figure, mating edges 30 of section 16 are in contact with mating edges 32 of section 18. In one embodiment, mating edges 30 and 32 can comprise sealing profile 34. In further embodiments, sealing profile 34 can comprise a tongue and groove profile that enables mating edges 30 and 32 to interlock with one another when apparatus 10 is enclosed about a pipe joint.

Sealing profile 34 can act to prevent drilling fluids from escaping apparatus 10 along the edges of sections 16 and 18 when the pipe joint is broken. In a representative embodiment, sealing profile 34 can comprise two tongues and two grooves whereby each tongue and groove along mating edges 30 and 32 forms an individual seal line along the edges. With the double tongue and groove arrangement, two consecutive seal lines are formed along the mating edges when apparatus 10 is in a closed position.

Figure 6:
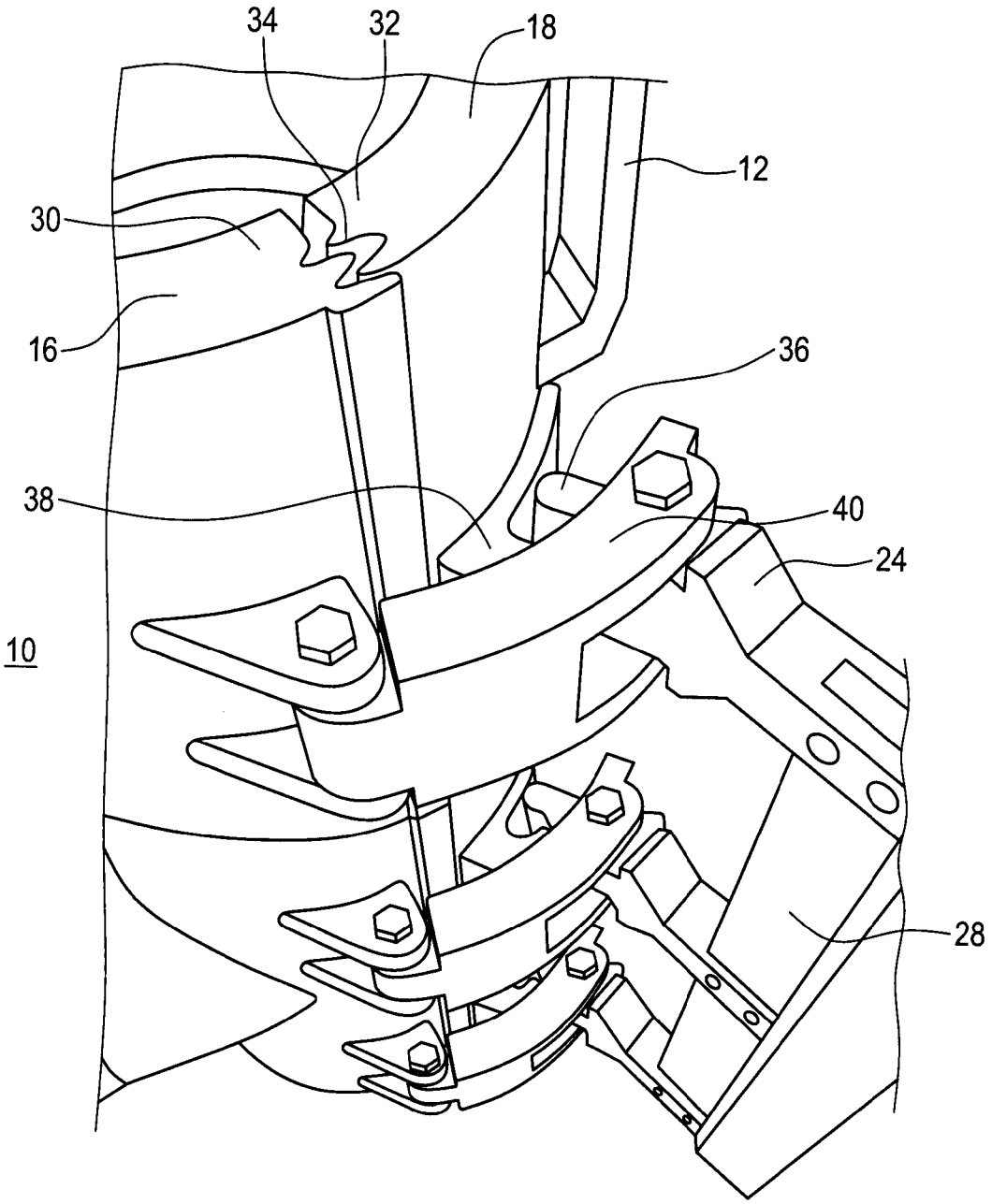
FIG. 6 is a side perspective view depicting the apparatus of FIG. 3 in a closed position with the latching mechanism being unlatched.
Figure 7:
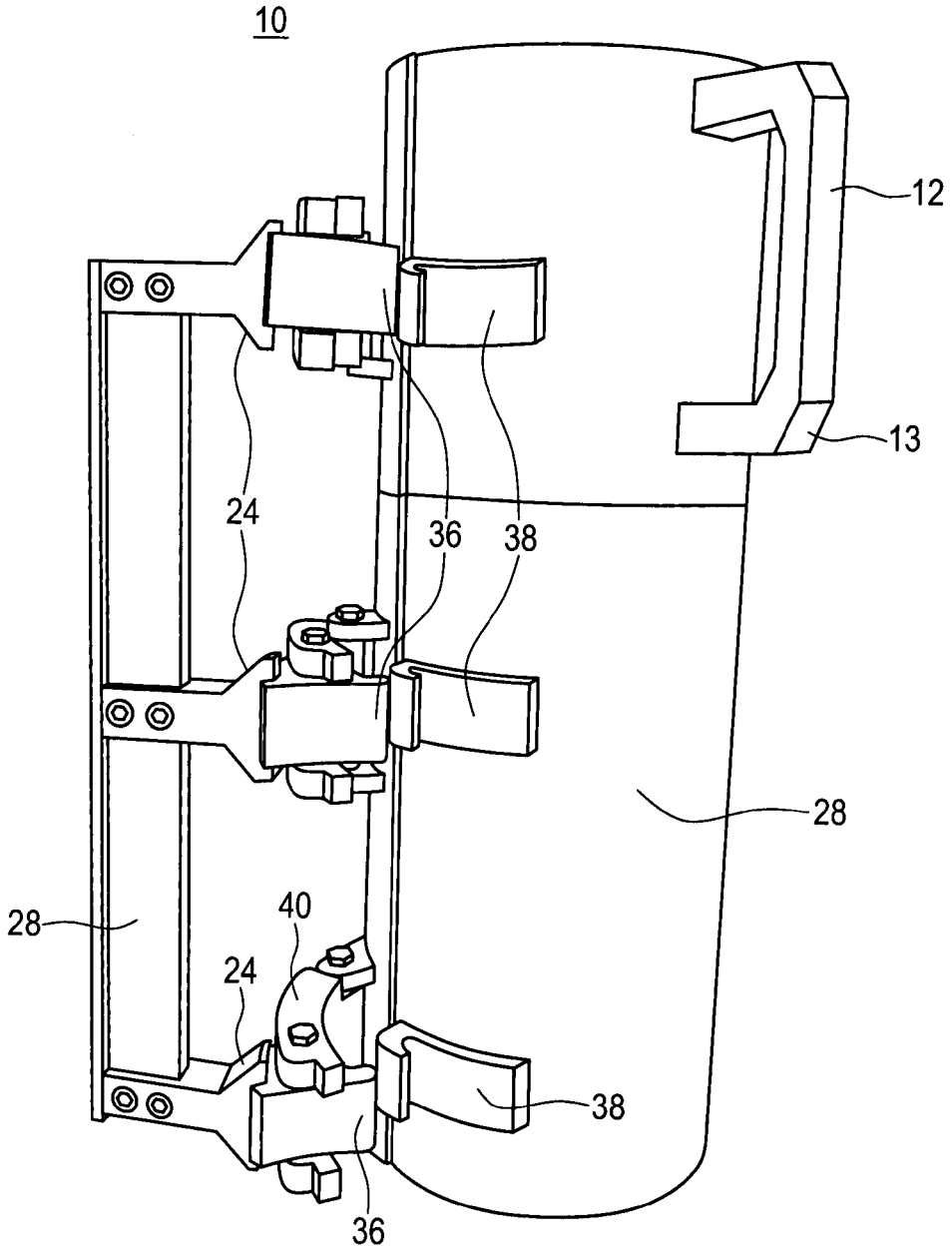
FIG. 7 is a side elevation view depicting the apparatus of FIG. 6.
Figure 8:
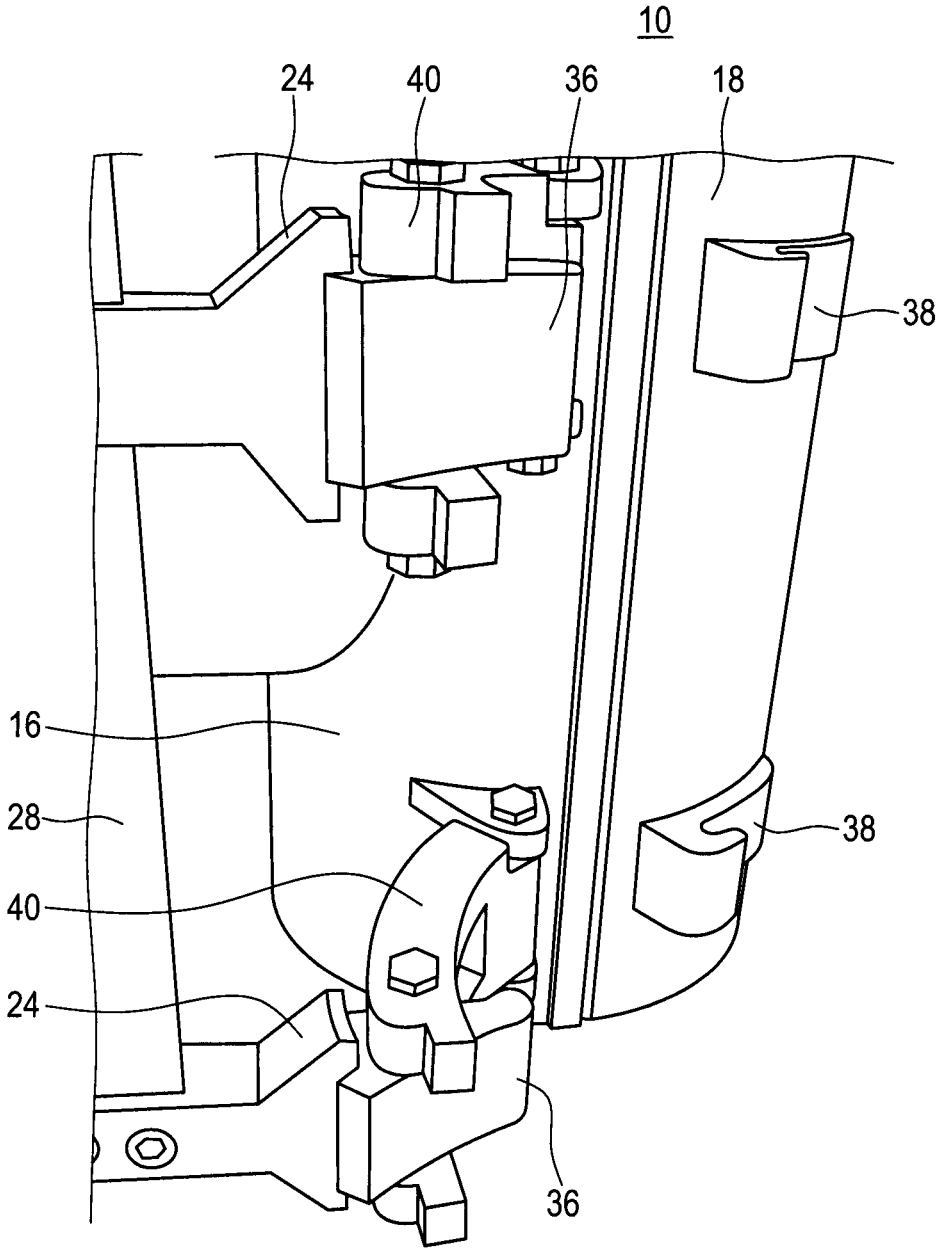
FIG. 8 is a side perspective view depicting the apparatus of FIG. 6 with the latching mechanism fully disengaged.

Referring to FIGS. 6 to 8, latch mechanisms 24 of apparatus 10 are depicted. In FIG. 6, latch mechanisms 24 are shown in a partially open position. In one embodiment, latch mechanism 24 can comprise an over-center style latch although any equivalent style of latch can be used as obvious to those skilled in the art. In the illustrated embodiment, each latch mechanism 24 can comprise latch hinge member 40 pivotally attached to section 16 that can further comprise hook member 36 pivotally attached to latch hinge member 40. Hook member 36 is configured to engage catch member 38 disposed on section 18. As shown, latch mechanisms 24 are ganged together by latch handle 28. Moving latch handle 28 towards section 18 causes hook members 36 to engage catch members 38 until latch handle 28 reaches the over-center position thereby keeping latch mechanisms 24 in a fully latched position. Moving latch handle 28 away from section 18 releases hook members 36 from catch members 38 (as shown in FIG. 7) thereby enabling apparatus 10 to be opened by moving sections 16 and 18 away from one another (as shown in FIG. 8).

Figure 9:
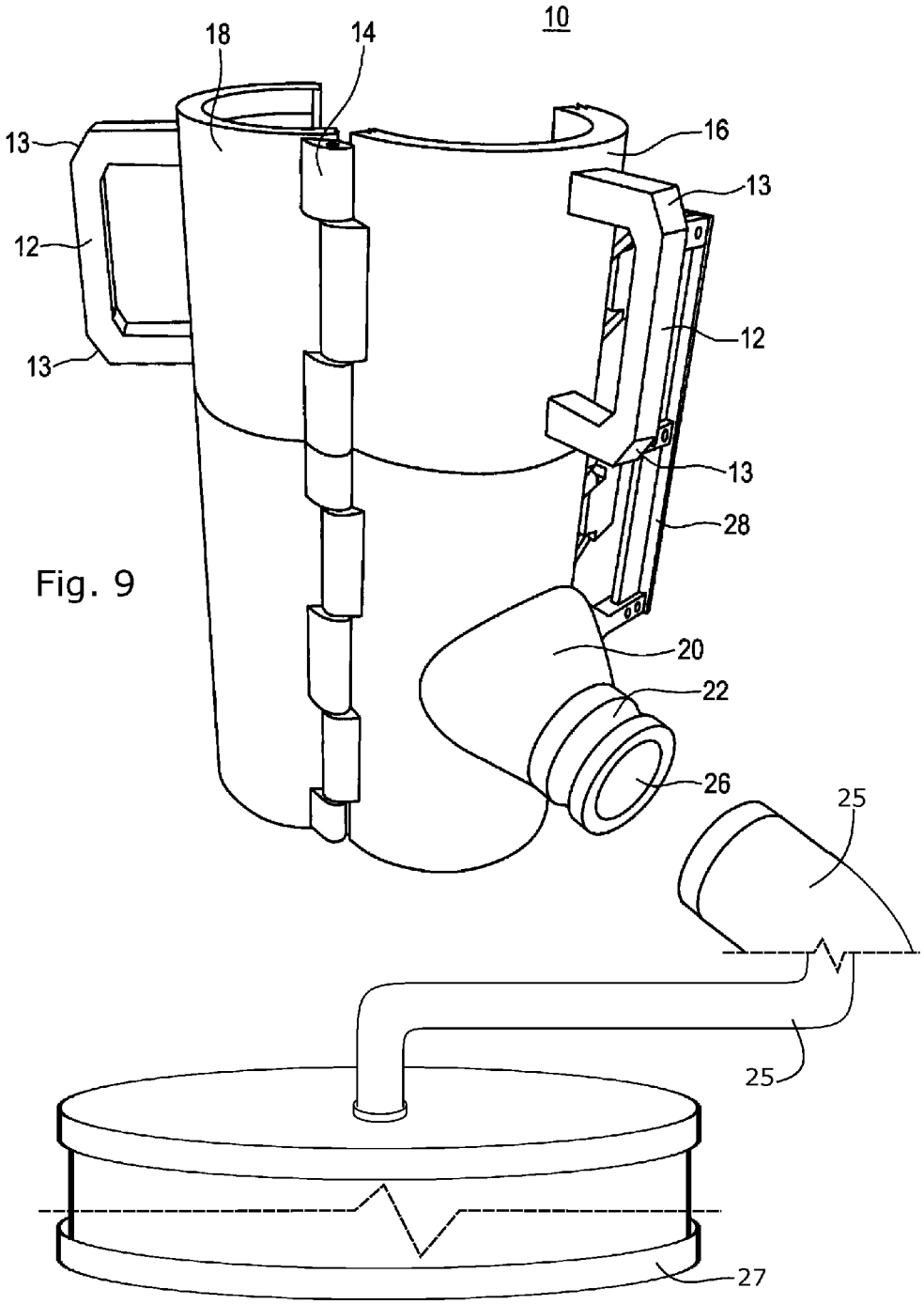
FIG. 9 is a side perspective view depicting the outside of the apparatus of FIG. 6 in an open position.

Referring to FIG. 9, apparatus 10 is shown in an open position with spout 20 shown disposed on the outer surface of section 16. In one embodiment, spout 20 can comprise a frustoconical or funnel shape culminating in outlet 26. In a further embodiment, spout 20 can comprise circumferential groove 22 for providing means for coupling with a hose 25 that diverts drilling fluid off of the drilling rig floor to a holding tank or other receptacle 27.

Figure 10:
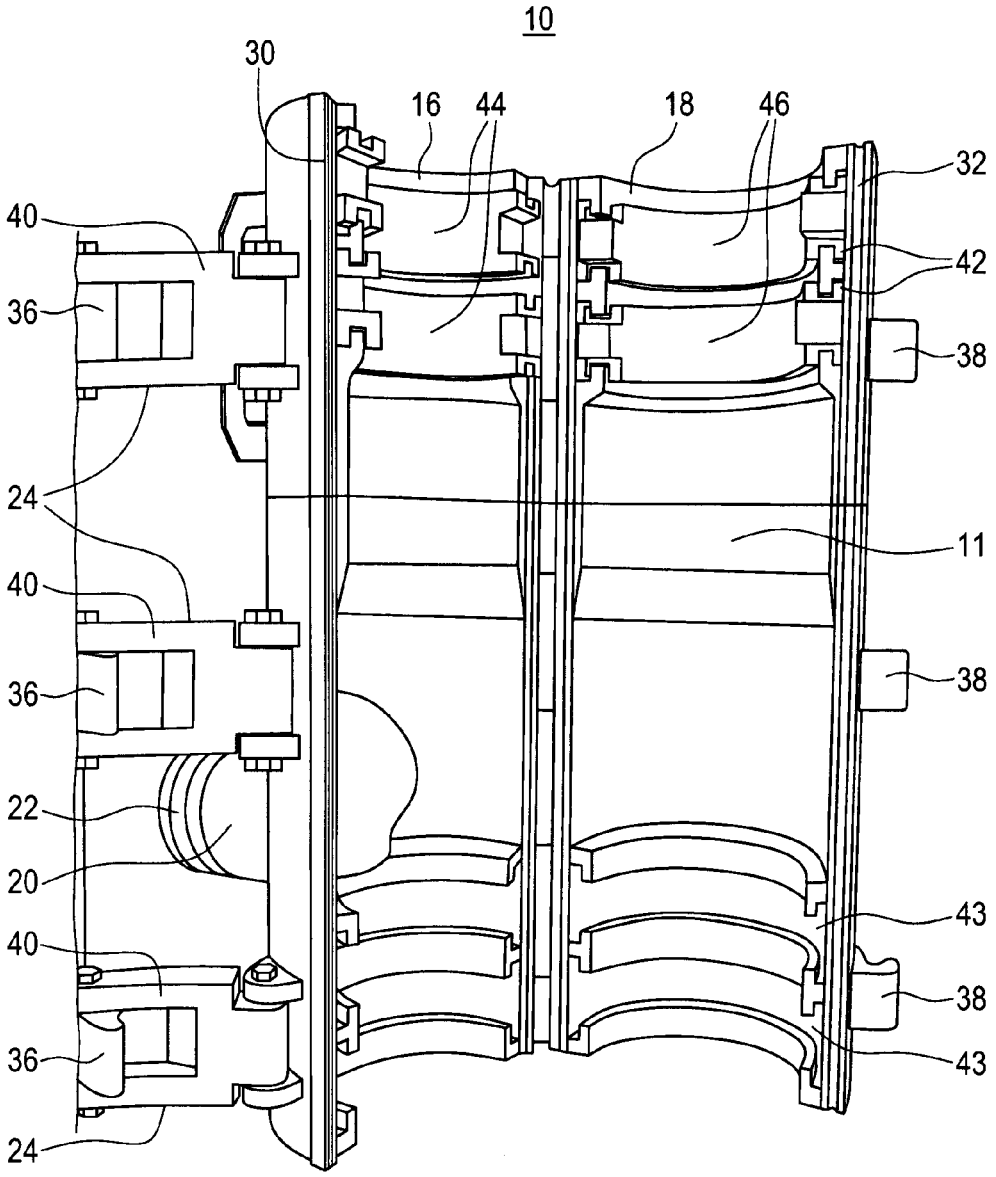
FIG. 10 is a side elevation view depicting the inside of the apparatus of FIG. 6 in an open position.

Referring to FIG. 10, apparatus 10 is shown in an open position displaying interior 11. In one embodiment, upper seal grooves 42 can be disposed at the upper end of sections 16 and 18 within interior 11. In another embodiment, lower seal grooves 43 can be disposed at the lower end of sections 16 and 18 within interior 11. In a representative embodiment, sections 16 and 18 can comprise two upper seal grooves 42 and two lower seal grooves 43 although it is obvious to those skilled in the art that the number of seal grooves is a design choice, and that fewer or more seal grooves can be used depending on the size of the pipe, the pipe joint and the volume and pressure of drilling fluid released when the pipe joint is broken. For the purposes of this specification, the term "outer upper seal groove" shall refer to the upper seal groove 42 closest to the exterior of apparatus 10 whereas the term "inner upper seal groove" shall refer to the upper seal groove 42 closest to the interior of apparatus 10. Similarly, the term "outer lower seal groove" shall refer to the lower seal groove 43 closest to the exterior of apparatus 10 whereas the term "inner lower seal groove" shall refer to the lower seal groove 43 closest to the interior of apparatus 10.

Figure 11:
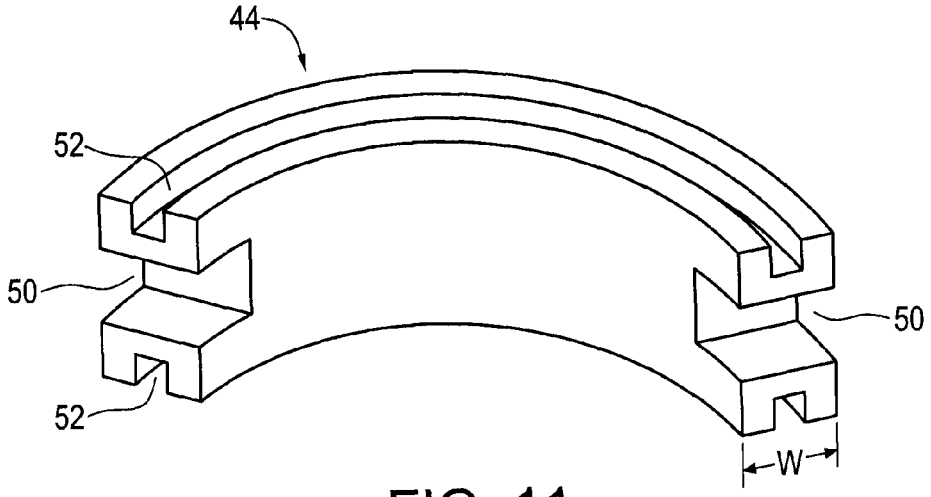
FIG. 11 is a side perspective view depicting a second embodiment of a seal for use with the apparatus of FIG. 1 or 3.
Figure 12:
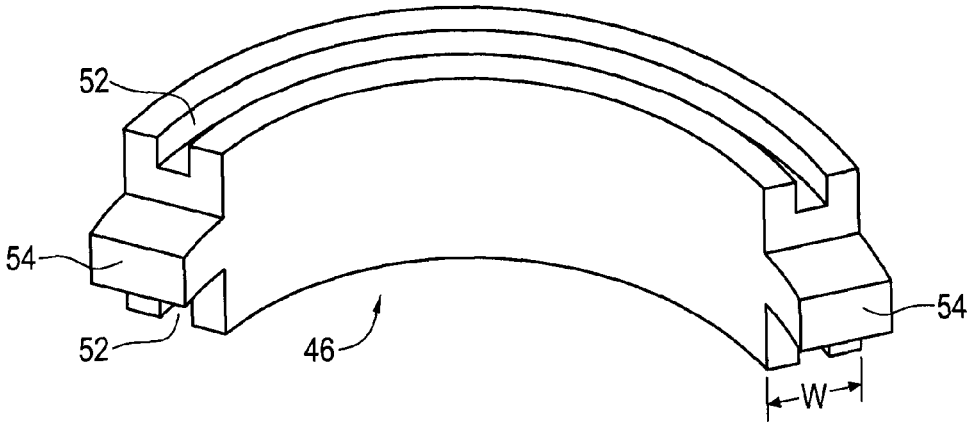
FIG. 12 is a side perspective view depicting the drain port of the apparatus of FIG. 10.

In one embodiment, seal grooves 42 and 43 can be configured with a T-shaped groove opening to receive a seal segment that can be slidably inserted and removed therefrom although any suitable groove shape can be used that can releasably retain a seal segment configured to inserted therein. Referring to FIG. 11, one embodiment of seal segment 44 is shown. In this embodiment, seal segment 44 can be comprised of an arcuate member made of elastomeric sealing material configured to be slidably inserted into upper seal groove 42 or lower seal groove 43. Referring to FIG. 12, one embodiment of seal segment 46 is shown, also comprised of an arcuate member made of elastomeric sealing material configured to be slidably inserted into upper seal groove 42 or lower seal groove 43. Seal segments 44 and 46 can be comprised of any suitable elastomeric material as well known by those skilled in the art that enable seal members 44 and 46 to flex, stretch and/or compress so as to maintain a sealing contact with the external surface of the pipe due to any irregularities to the cross-sectional shape of the pipe or to the contour of the pipe's external. Suitable examples of the elastomeric material for seal members 44 and 46 can include natural rubber, neoprene rubber, foam rubber, silicone-based rubber, nitrile rubber, foam plastic and any other material known to those skilled in the art that is suitable for use as a seal around a drill string. In a representative embodiment, seal segments 44 and 46 can be comprised of polyethylene cross-linked foam plastic.

In one embodiment, seal segment 44 can comprise notches 50 on each end whereas seal segment 46 can comprise protrusions 54 configured to snugly insert into notches 50 when sections 16 and 18 are enclosed about a pipe joint thereby forming a continuous circular or toroidal seal around the pipe when apparatus 10 is fully enclosed around the pipe joint.

In one embodiment, seal segment 44 can comprise grooves 52 disposed on the top and bottom surfaces thereof to provide means to enable seal segment 44 to be slidably inserted into T-shaped upper or lower seal grooves 42 and 43. It is obvious to those skilled in the art that seal segments 44 or 46 can comprise other means besides grooves 52 to enable the seal segments to be releasably inserted in upper or lower seal grooves 42 and 43 if grooves 42 or 43 do not comprise a T-shaped opening. By providing seal segments of this configuration, worn or damaged seal segments can be easily replaced by drilling rig floor personnel without any special tools, skills or knowledge.

Referring to FIGS. 11 and 12, each seal segment 44 and 46 comprises width W. Width W is selected as a design consideration in accordance with the diameter of pipe being used in the drilling operation. The width W of seal segments 44 and 46 is inversely proportional to the diameter of pipe or Kelly used. Width W can be selected to be narrower for larger diameter pipes, and wider for narrower diameter pipes. In another embodiment, apparatus 10 can be supplied as or with a kit having a plurality of seal segments 44 and 46 of varying widths W thereby enabling apparatus 10 to be used with pipes of various diameters. In a representative embodiment, apparatus 10 can be provided in a kit with a plurality of seal segments 44 and 46 where the segments are configured to be used with pipes whose diameter can range from 1 inch to 5 inch.

In another embodiment, seal segments 44 and 46 of varying sizes can be used in a single apparatus 10. In such configurations, apparatus 10 can be referred to as having "staged seals". As an example, the upper and lower outer seal grooves can be fitted with seal segments that are wider than the seal segments fitted in the upper and lower inner seal grooves. By doing so, the outer seal segments can fit snugly around the pipe above and below the pipe joint whereas the inner seal segments can fit snugly around the pipe joint itself, which is larger in diameter than the pipe's diameter.

In another embodiment, sections 16 and 18 can comprise two upper seal grooves 42 and two lower seal grooves 43 to enable the use of seal segments 44 and 46 that have differing properties. As an example, apparatus 10 can also be used as a pipe stripper and wiper where apparatus 10 is held stationary by personnel while the pipe is raised upwards through apparatus 10 by the drilling rig elevator. In this configuration, the outer and inner lower seal grooves can be fitted with seal segments that are dense and hard to compress, which make these seal segments better suited for scraping or stripping off larger or heavier solids attached from the exterior of the pipe. In addition, the outer and inner upper seal grooves can be fitted with seal segments that are less dense and easier to compress, which makes these seal segments better suited for wiping off residual fluids from the pipe's exterior and even compress enough to pass over the pipe joint as the drill string is raised up from the well.

Figure 13:
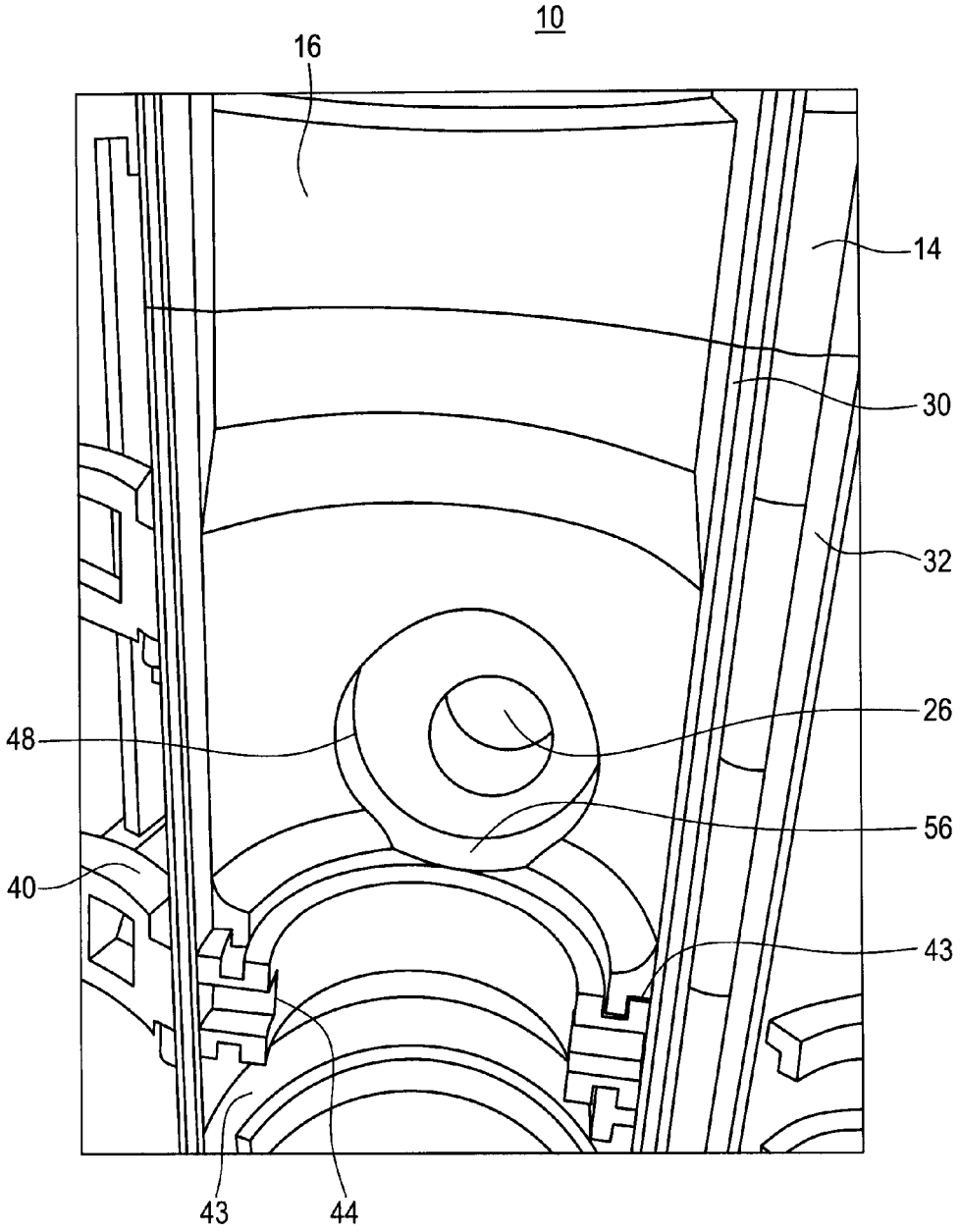
FIG. 13 is a side perspective view depicting a first embodiment of a seal for use with the apparatus of FIG. 1 or 3.

Referring to FIG. 13, apparatus 10 is shown in an open position, exposing interior 11 thereof, specifically, the interior side of section 16. In this embodiment, spout opening 48 is shown and provides communication to spout outlet 26 of spout 20 as shown in FIGS. 1 to 4. In one embodiment, spout opening 48 can have a funnel shape that narrows in diameter towards spout outlet 26. In another embodiment, spout opening 48 can have flat bottom surface 56 that can positioned to be substantially level with the top edge on the lower inner seal groove. In this configuration, the amount of residual drilling fluid that remains in apparatus 10 when drilling fluid is released within apparatus 10 upon breaking a pipe joint can be minimized. In applications where apparatus 10 is used to enclose a pipe joint on pipe being removed from a snubbing unit on a gas producing well, embodiments of apparatus 10 can be adapted to contain gas that is released when the pipe joint is disconnected or broken whereby the gas can exit apparatus 10 through spout 20 to a gas containment vessel (not shown) via a hose (not shown) connected to spout 20.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

We claim:

1. An apparatus for use in containing fluid or gas that is released upon disconnection of a threaded joint between sections of pipe or between a Kelly and a pipe section, the apparatus comprising:

a) at least two arcuate sections of a generally tubular housing having upper and lower ends and outer and inner surfaces, the sections hinged together and configured to substantially enclose the threaded joint thereby providing a generally cylindrical enclosure disposed about the threaded joint;

b) a handle disposed on at least one arcuate section;

c) at least one upper groove disposed on the inner surface of the upper end of each arcuate section whereby at least one upper circumferential groove is formed on the inner surfaces when the arcuate sections are enclosed about the threaded joint;

d) at least one lower groove disposed on the inner surface of the lower end of each arcuate section whereby at least one lower circumferential groove is formed on the inner surfaces when the arcuate sections are enclosed about the threaded joint;

e) sealing means disposed in the at least one upper and lower circumferential grooves for providing a sealing contact with the Kelly or with the pipe section when the arcuate sections are enclosed about the threaded joint, and wherein i) the sealing means comprise elastomeric seals, ii) the elastomeric seals comprise at least plastic foam, iii) the plastic foam comprises cross-linked polyethylene foam, iv) the elastomeric seal disposed in the at least one upper circumferential groove comprises a first foam density, v) the arcuate seal section disposed in the at least one lower circumferential groove comprises a second foam density whereby the first foam density is not equal to the second foam density;

f) latching means for releasable latching the arcuate sections together when the housing is enclosed about the threaded joint, the latching means comprising at least one latching mechanism; and g) a spout disposed on the outer surface of at least one of the at least two arcuate sections near the lower end and above the at least one lower groove, the spout configured to provide communication between the outer and inner surfaces thereby providing a path for drilling fluid to flow through when the arcuate sections are enclosed about the threaded joint and the threaded joint is disconnected.

2. The apparatus as set forth in claim 1, wherein the latching means further comprises a plurality of latching mechanisms in a spaced-apart configuration disposed on the outer surface of the arcuate sections.

3. The apparatus as set forth in claim 2, wherein the latching mechanisms are ganged together to operate in unison.

4. The apparatus as set forth claim 1 wherein the latching mechanism is selected from one or more from the group consisting of over-center latches, hook and catch latches and loop and catch latches.

5. The apparatus as set forth in claim 1, wherein the sealing means comprise arcuate seal sections configured to be removably disposed in each of the at least one upper and lower grooves of the arcuate sections.

6. The apparatus as set forth in claim 1, wherein at least one of the upper and lower grooves further comprise a T-shaped slot.

7. The apparatus as set forth in claim 6, wherein the sealing means comprise arcuate seal sections further comprising a T-shaped profile configured to be removably inserted in the T-shaped slot of the at least one upper or lower groove.

8. The apparatus as set forth in claim 1, wherein the elastomeric seal comprising at least plastic foam is further comprised of one or more of the group consisting of natural rubber, neoprene rubber, foam rubber, silicone-based rubber, and nitrile rubber.

9. The apparatus as set forth in claim 1, wherein each arcuate section comprises at least two upper grooves, or at least two lower grooves, or both.

10. The apparatus as set forth in claim 9, further comprising seal segments disposed in each of the at least two upper grooves, of the at least two lower grooves or of both.

11. The apparatus as set forth in claim 1, further comprising a hose configured to couple to the spout and direct drilling fluid to a receptacle when the housing is disposed about the threaded joint and when the threaded joint is disconnected.

12. A method of containing fluid or gas that is released upon disconnection of a threaded joint between sections of pipe or between a Kelly and a pipe section, the method comprising the steps of:

providing an apparatus, comprising:

i) at least two arcuate sections of a generally tubular housing having upper and lower ends and outer and inner surfaces, the arcuate sections hinged together and configured to substantially enclose the threaded joint thereby providing a generally cylindrical enclosure disposed about the threaded joint;

ii) a handle disposed on at least one tubular housing section, iii) at least one upper groove disposed on the inner surface of the upper end of each arcuate section whereby at least one upper circumferential groove is formed on the inner surfaces when arcuate sections are enclosed about the threaded joint, iv) at least one lower groove disposed on the inner surface of the lower end of each arcuate section whereby at least one lower circumferential groove is formed on the inner surfaces when the arcuate sections are enclosed about the threaded joint, v) sealing means disposed in the at least one upper and lower circumferential grooves for providing a sealing contact with the Kelly or with the pipe section when the arcuate sections are enclosed about the threaded joint, and wherein (a) the sealing means comprises elastomeric seals, (b) the elastomeric seals comprise at least plastic foam, (c) the plastic foam comprises cross-linked polyethylene foam, (d) the elastomeric seal disposed in the at least one upper groove comprises a first foam density, (e) the elastomeric seal disposed in the at least one lower groove comprises a second foam density whereby the first foam density is not equal to the second foam density, vi) latching means for releasably latching the arcuate sections together when the arcuate sections are enclosed about the threaded joint, the latching means comprising at least one latching mechanism, and vii) a spout disposed on the outer surface of at least one of the at least two arcuate sections near the lower end and above the at least one lower groove, the spout configured to provide communication between the outer and inner surfaces thereby providing a path for drilling fluid to flow through when the housing is enclosed about the threaded joint and the threaded joint is disconnected; and placing the apparatus around the threaded joint, thereby enclosing the threaded joint.

13. The method as set forth in claim 12, wherein the latching means further comprises a plurality of latching mechanisms in a spaced-apart configuration disposed on the outer surface of the arcuate sections.

14. The method as set forth in claim 13, wherein the latching mechanisms are ganged together to operate in unison.

15. The method as set forth in claim 12, wherein the latching mechanism is selected from one or more from the group consisting of over-center latches, hook and catch latches and loop and catch latches.

16. The method as set forth in claim 12, wherein the sealing means comprise arcuate seal sections configured to be removably disposed in each of the at least one upper and lower grooves of the arcuate sections.

17. The method as set forth in claim 12 wherein at least one of the upper and lower grooves further comprise a T-shaped slot.

18. The method as set forth in claim 12, further comprising:

a) attaching one end of a hose to the spout, and placing the other end of the hose at a receptacle; and b) disconnecting the thread joint within the apparatus, whereby drilling fluid exiting from the Kelly from the pipe section flows through from the apparatus though the spout and the hose to the receptacle.

19. The method as set forth in claim 12, wherein the elastomeric seal comprising at least plastic foam is further comprised of one or more of the group consisting of natural rubber, neoprene rubber, foam rubber, silicone-based rubber, and nitrile rubber.

20. The method as set forth in claim 12, wherein each arcuate section comprises at least two upper grooves, or at least two lower grooves, or both.

* * * * *